US010280827B2

(12) United States Patent
Ichihashi et al.

(10) Patent No.: US 10,280,827 B2
(45) Date of Patent: May 7, 2019

(54) ENGINE AND ENGINE-DRIVEN WORKING MACHINE

(71) Applicant: HITACHI KOKI CO., LTD., Tokyo (JP)

(72) Inventors: Naoto Ichihashi, Ibaraki (JP); Keisuke Ikeda, Ibaraki (JP); Kazuhiro Ootsuka, Ibaraki (JP)

(73) Assignee: Koki Holdings Co., Ltd., Tokyo (JP)

( * ) Notice: Subject to any disclaimer, the term of this patent is extended or adjusted under 35 U.S.C. 154(b) by 0 days.

(21) Appl. No.: 15/547,518

(22) PCT Filed: Feb. 26, 2016

(86) PCT No.: PCT/JP2016/055838
§ 371 (c)(1),
(2) Date: Jul. 31, 2017

(87) PCT Pub. No.: WO2016/152382
PCT Pub. Date: Sep. 29, 2016

(65) Prior Publication Data

US 2018/0016964 A1 Jan. 18, 2018

(30) Foreign Application Priority Data

Mar. 25, 2015 (JP) ..... 2015-063511

(51) Int. Cl.
*F01P 1/02* (2006.01)
*F02B 63/02* (2006.01)
(Continued)

(52) U.S. Cl.
CPC ..... *F01P 1/02* (2013.01); *F01N 1/00* (2013.01); *F01N 1/08* (2013.01); *F01N 1/14* (2013.01);
(Continued)

(58) Field of Classification Search
CPC ..... F01P 1/02; F01N 1/00; F01N 1/08; F01N 13/082; F02B 63/02
See application file for complete search history.

(56) References Cited

FOREIGN PATENT DOCUMENTS

JP 59-073525 5/1984
JP 2000018033 1/2000
(Continued)

OTHER PUBLICATIONS

"International Search Report (Form PCT/ISA/210) of PCT/JP2016/055838", dated May 31, 2016, with English translation thereof, pp. 1-2.

*Primary Examiner* — Kevin A Lathers
(74) *Attorney, Agent, or Firm* — JCIPRNET

(57) ABSTRACT

An engine is configured so that a muffler is affixed to the exhaust opening of the cylinder, and the air-cooled cylinder is cooled by a cooling fan. The engine is provided with a muffler cover for covering the muffler, and exhaust gas is discharged inside the muffler cover along the wall surface of the muffler. A second cooling air is combined with the exhaust gas flow from the upstream side thereof to be parallel thereto, and a first cooling air having been caused to flow under the muffler is caused to perpendicularly impinge against the exhaust gas flow on the downstream side thereof. Thus, the cooling airs are combined inside the muffler cover with the exhaust gas flow, and as a result the temperature of the exhaust gas is sufficiently reduced at the time when the exhaust gas is discharged from the opening of the muffler cover to the outside.

9 Claims, 9 Drawing Sheets

(51) Int. Cl.

| | |
|---|---|
| ***F01N 13/08*** | (2010.01) |
| ***F01P 1/06*** | (2006.01) |
| ***F01N 1/00*** | (2006.01) |
| ***F01N 1/14*** | (2006.01) |
| ***F01N 1/08*** | (2006.01) |
| ***F01P 5/02*** | (2006.01) |
| ***F02B 63/04*** | (2006.01) |
| ***F02B 75/16*** | (2006.01) |

(52) U.S. Cl.

CPC ..... *F01N 13/082* (2013.01); *F01P 1/06* (2013.01); *F01P 5/02* (2013.01); *F02B 63/02* (2013.01); *F02B 63/04* (2013.01); *F02B 75/16* (2013.01); *F01N 2260/022* (2013.01); *F01N 2260/20* (2013.01); *F01N 2270/02* (2013.01); *F01N 2590/06* (2013.01); *F01P 2001/023* (2013.01); *F01P 2060/16* (2013.01)

(56) References Cited

FOREIGN PATENT DOCUMENTS

| | | | | | |
|---|---|---|---|---|---|
| JP | 2013068140 | A | * | 4/2013 | ..... F01N 3/046 |
| JP | 2013213414 | | | 10/2013 | |

* cited by examiner

ENGINE AND ENGINE-DRIVEN WORKING MACHINE

CROSS-REFERENCE TO RELATED APPLICATION

This application is a 371 application of the international PCT application serial no. PCT/JP2016/055838, filed on Feb. 26, 2016, which claims the priority benefit of Japan application no. 2015-063511, filed on Mar. 25, 2015. The entirety of each of the above-mentioned patent applications is hereby incorporated by reference herein and made a part of this specification.

TECHNICAL FIELD

The present invention mainly relates to a cooling structure for an exhaust gas from an engine used as a power source of an engine-driven working machine such as a bush cutter, an air blower, a chain saw, or the like, and a generator, or the like.

BACKGROUND ART

In a small engine-driven working machine, since an engine may be disposed adjacent to an operator or a high temperature exhaust gas may be discharged from a muffler, various attempts have been made to install a muffler cover to prevent the operator from coming in direct contact with a muffler or decrease the temperature of an exhaust gas discharged outside of the muffler cover. For example, in Patent Literature 1, an exhaust gas temperature is decreased by introducing cooling air generated by a cooling fan into a muffler chamber and mixing an exhaust gas with the cooling air in a cover.

CITATION LIST

Patent Literature

Patent Literature 1
Japanese Unexamined Patent Application Publication No. 2013-213414

SUMMARY OF INVENTION

Technical Problem

In the technology of Patent Literature 1, when exhaust gas and cooling air are mixed, since an exhaust outlet of a muffler is adjacent to an exhaust outlet section of a muffler cover, there is a likelihood that the exhaust gas temperature may not be able to be sufficiently decreased when the exhaust gas is discharged outside of the muffler cover even though the exhaust gas and the cooling air are mixed in the vicinity of an exhaust outlet of the muffler cover. In addition, since the muffler cover is present on a pathway of the cooling air that merges with the exhaust gas, a flow of the exhaust gas may be disturbed by the cooling air, and the disturbed exhaust gas may come in contact with the muffler cover, causing discoloration or deterioration of the muffler cover due to elements contained in the exhaust gas or an increase in temperature. When an area of an opening surface of an exhaust outlet section of the muffler cover needs to be increased by increasing a distance between the muffler and the muffler cover to avoid a discoloration/deterioration phenomenon, it is difficult to reduce a size of an engine-driven working machine due to such a measure.

In consideration of the above-mentioned circumstances, an object of the present invention is to provide an engine and an engine-driven working machine that are capable of accomplishing a sufficient cooling effect for an exhaust gas with no increase in distance between a muffler cover and a muffler.

Another aspect of the present invention is to provide an engine and an engine-driven working machine, in which an exhaust gas is discharged outside of a muffler cover after an exhaust gas temperature is sufficiently decreased in a housing or a cover of the engine.

Solution to Problem

Representative features of the present invention disclosed herein will be described as follows. According to a feature of the present invention, there is provided an engine including: a cylinder having a plurality of fins on an outer circumferential section thereof and in which a combustion chamber is formed; a cooling fan configured to generate cooling air to cool the cylinder; and a substantially rectangular parallelepiped muffler attached to the cylinder, wherein an exhaust gas outlet is installed in the muffler to discharge an exhaust gas along a first wall surface of the muffler in a direction perpendicular to an axial direction of the cylinder, and first cooling air passing through and between the fins flows along a second wall surface disposed at a downstream side in a discharge direction of the exhaust gas when seen from the first wall surface and merges with the exhaust gas through collision therewith. Since the first cooling air is mixed with the exhaust gas due to this configuration, the exhaust gas temperature can be greatly reduced. In addition, an exhaust gas passage including the exhaust gas outlet and configured to determine a discharge direction of the exhaust gas is formed in the muffler and the exhaust gas passage is disposed to be biased at an upstream side in an exhaust gas outflow direction on the first wall surface of the muffler. According to this configuration, since a distance between the exhaust gas outlet of a exhaust gas restriction member and a crossing region can be increased, a distance over which the second cooling air and the exhaust gas can be mixed together can be increased, and an exhaust gas temperature can be further reduced.

According to another feature of the present invention, a muffler cover configured to cover the muffler to form a muffler chamber is provided, an opening configured to discharge the exhaust gas into external air is formed in the muffler cover, and a crossing region of the first cooling air and the exhaust gas is formed to be disposed inside of an outer exterior edge position of the muffler cover. The first cooling air and the exhaust gas can be reliably mixed in the muffler cover due to this configuration, and the exhaust gas temperature can be sufficiently reduced when the exhaust gas is discharged outside of the muffler cover. In addition, ribs configured to guide the exhaust gas are formed in a portion of an edge of the opening of the muffler cover to extend in a direction parallel to a discharge direction of the exhaust gas. Accordingly, a discharge direction of the exhaust gas can be straightened during an operation of the engine while foreign substances or waste cannot easily hit the muffler from the vicinity of the opening during stoppage.

According to still another feature of the present invention, second cooling air flowing through and between the fins flows along the first wall surface after flowing along a third wall surface disposed on an upstream side in the discharge direction of the exhaust gas from the first wall surface and non-adjacent to the second wall surface, and merges with the exhaust gas substantially in parallel from an upstream side in an outflow direction of the exhaust gas. Since an air flow layer is formed between the exhaust gas and the muffler cover by the second cooling air because the second cooling air merges with the exhaust gas substantially in parallel from an upstream side in an exhaust gas outflow direction in this way, even when a distance between the muffler and the muffler cover is reduced and the muffler cover is reduced in size, the second cooling air and the exhaust gas can be mixed together to decrease the exhaust gas temperature without the exhaust gas coming in contact with the muffler cover.

According to still another feature of the present invention, a crankshaft configured to extract an output of the engine is provided, the cooling fan is installed at one end of the crankshaft, the muffler is disposed on an opposite side of an axis of the cylinder when seen from the cooling fan, and the first cooling air and the second cooling air are exhausted after cooling the cylinder. Since there is no need to extract some of the cooling air from the cooling fan due to this configuration and form an air duct separately from the cylinder, a compact structure can be provided at low cost. Further, the amount of air for cooling the cylinder is reduced by extracting some of the cooling air and the cylinder temperature is not increased. Conventionally, since an exhaust wind (for example, 100° C. or less) of the cylinder cooling air is sufficiently lower than the exhaust gas temperature (for example, 400° C. to 500° C.), an effect of reducing the exhaust gas temperature can be sufficiently obtained.

According to still another feature of the present invention, a shielding section configured to convert a flow of the second cooling air from along the third wall surface to a flow along the first wall surface is formed on the muffler cover. Since an air flow layer is formed by the second cooling air between the muffler cover and the muffler due to this configuration, the muffler cover can be protected from high temperature air around the muffler. In addition, since the muffler itself can be cooled such that a temperature of the muffler surface is also decreased, less radiant heat is able to be transferred from the muffler to the muffler cover. Accordingly, even when a distance between the muffler and the muffler cover is decreased and the muffler cover is reduced in size, the muffler cover temperature can be sufficiently decreased.

According to still another feature of the present invention, there is provided an engine including: a cylinder having a plurality of fins on an outer circumferential section thereof and in which a combustion chamber is formed; a cooling fan configured to generate cooling air to cool the cylinder; and a substantially rectangular parallelepiped muffler attached to the cylinder, wherein the muffler is biasedly disposed such that a central position in the muffler is offset in a tangential direction with respect to a central position in an outer side of the radiation fins when seen in an axial direction of the cylinder, first cooling air exhausted after cooling the cylinder flows into a space opened by the biased disposition, and an exhaust gas outlet is configured to discharge an exhaust gas in a direction in which the exhaust gas collides with the first cooling air along a first wall surface of the muffler disposed at an opposite side when seen from the cylinder. Since an air duct can be continuously formed from the cylinder toward the muffler with no curves due to this configuration and thus the first cooling air and the exhaust gas merge with each other, the exhaust gas temperature can be effectively reduced.

Advantageous Effects of Invention

According to the present invention, cooling of a muffler and an exhaust gas can be efficiently performed using cooling air after cooling a cylinder. In particular, it is possible to realize an engine and an engine-driven working machine that are capable of sufficiently reducing an exhaust gas temperature when an exhaust gas is discharged outside of the muffler chamber.

DESCRIPTION OF EMBODIMENTS

[Embodiment 1]

Figure 1:
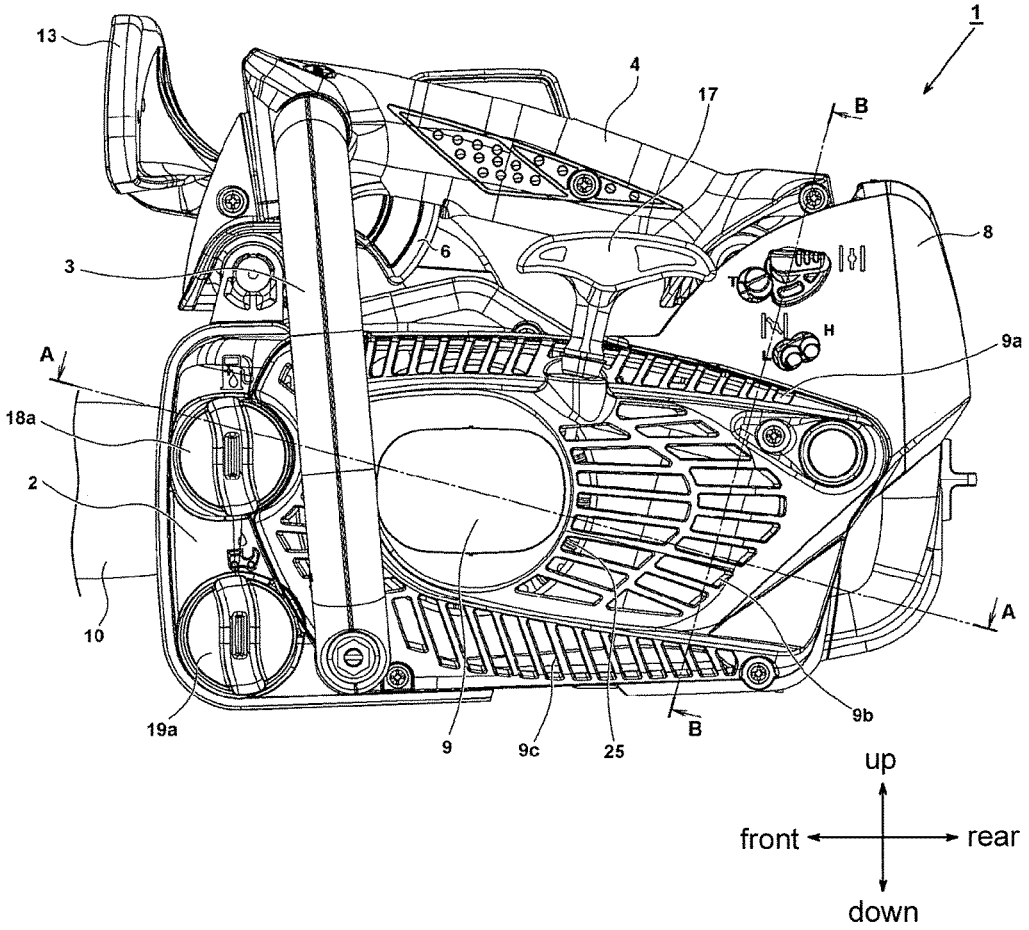
FIG. 1 is a left side view of a chain saw 1 according to an embodiment of the present invention.

Hereinafter, an embodiment of the present invention will be described with reference to the accompanying drawings. Further, in the following drawings, the same parts are designated by the same reference numerals, and repeated description thereof will be omitted. Further, in the following description, directions of forward, rearward, leftward, rightward, upward and downward are as shown in the drawings.

FIG. 1 is a side view of a fan side (a left side) of a chain saw 1 serving as an example of an engine-driven working machine. The chain saw 1 has a small engine (to be described below) accommodated in an engine cover 2. In the engine-driven working machine of the embodiment, an engine main body that generate heat, a rotary mechanism portion and a muffler portion are configured to be mostly covered by a cover formed of a metal or a synthetic resin as a whole. An engine (not shown) is fixed to the engine cover 2 formed of a synthetic resin. A flat plate-shaped guide bar 10 configured to guide a saw chain protruding toward a front side (a right side of the drawing) of the chain saw 1 is attached to the engine cover 2, and has a front handle 3 gripped by an operator and a rear handle (a top handle) 4 including a trigger 6 configured to adjust an output of the engine. In addition, a hand guard 13 is attached to a front side of the front handle 3 of the chain saw 1 to extend upward (an upper side of the drawing). A fan cover 9 configured to cover a cooling fan 25 installed on a crankshaft 24 (to be described with reference to FIG. 2) of the engine is installed on a left side surface of the engine cover 2. A plurality of ventilator windows 9*a*, 9*b* and 9*c* are installed on an upper surface, a rear side of a side surface, a lower surface and a front surface of the fan cover 9. A recoil type starter (not shown) is installed in the fan cover 9 and a starter handle 17 is disposed thereon. A fuel tank (to be described below with reference to FIG. 2) into which a blended fuel of gasoline and lubricating oil is input is installed at a front side of the engine cover 2, and a tank cap 18*a* configured to cover an opening section of the fuel tank is installed thereon. An oil cap 19*a* configured to close an opening for an oil tank (not shown) in which chain oil supplied to a saw chain is stored is installed below the tank cap 18*a*. An air cleaner chamber (not shown) is installed at a rear side of the engine, and the air cleaner chamber is covered by an air cleaner cover 8.

Figure 2:
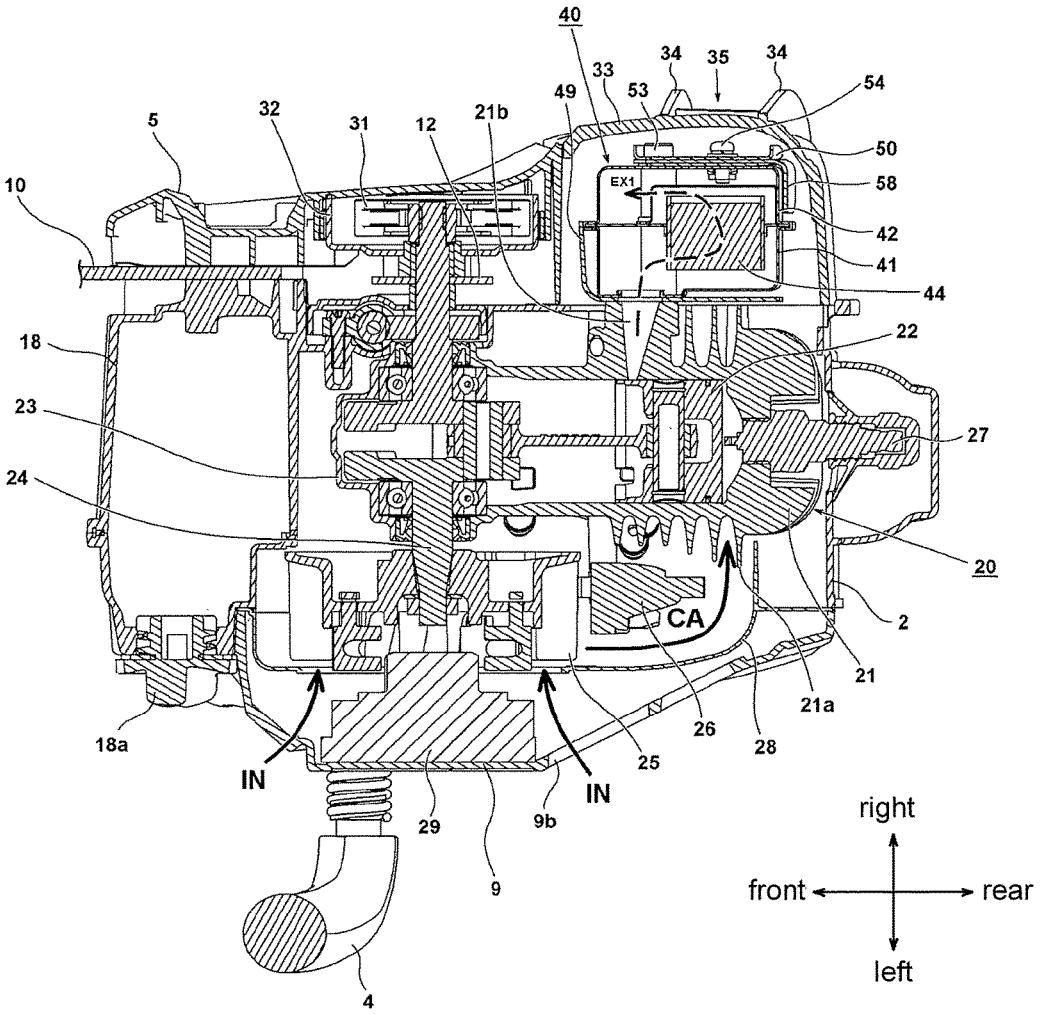
FIG. 2 is a cross-sectional view taken along line A-A of FIG. 1.

FIG. 2 is a cross-sectional view taken along line A-A of FIG. 1. The engine is configured to include an engine main body section 20, accessories such as a carburetor (to be described below), a muffler 40, or the like, and various covers such as the engine cover 2, the air cleaner cover 8 (see FIG. 1), the fan cover 9, a muffler cover 33, and so on. Whether all or some of the covers are installed on the engine main body section 20 may be selected by a manufacturer according to properties of a working device that is to be used. The engine main body section 20 is a 2-cycle air-cooled engine, the crankshaft 24 is disposed to extend in a leftward/rightward direction, and a reciprocal moving direction (an axis of a cylindrical surface of a cylinder) of a piston 22 is a forward/rearward direction. A plurality of radiation fins 21*a* are formed on an outer circumferential section of a cylinder 21 having a cylindrical shape, and the cylinder 21 is cooled as the radiation fins 21*a* are exposed to cooling air CA. Here, the cylinder 21 is manufactured by integrally forming an aluminum alloy, and six cooling fins are formed in a substantially plate shape to extend in a direction perpendicular to an axis of the cylinder 21 from a head portion at which an ignition plug 27 is disposed in a crankshaft direction. An exhaust hole 21*b* configured to discharge an exhaust gas from a combustion chamber is formed in a side surface (here, an upper side) of a cylindrical section of the cylinder 21, and the muffler 40 is attached by a bolt 53 to approach the exhaust hole 21*b*. Here, the engine main body section 20 and the muffler 40 have a shape in which an opening of the exhaust hole 21*b* of the cylinder 21 is directly joined to an opening of an introduction side of the muffler 40 with no intervention of a connecting pipeline. However, a muffler gasket 49 is interposed between the cylinder 21 and the muffler 40, and an adhesion property is increased.

Reciprocal movement of the piston 22 in a cylinder axial direction (a forward/rearward direction) is converted into rotation movement of the crankshaft 24 by a crank. A centrifugal clutch 31 is connected to one end side (a right side) of the crankshaft 24, and power is transmitted to a sprocket 12 rotated in conjunction with a clutch case 32 by the centrifugal clutch 31. A saw chain (not shown) is disposed at outer circumferential sides of the sprocket 12 and the guide bar 10, and the saw chain is rotatably driven by rotation of the sprocket 12. Surroundings of the sprocket 12 and the centrifugal clutch 31 are covered by a side cover 5. The cooling fan 25 configured to generate cooling air to cool the cylinder 21 is installed at the other end side (a left side) of the crankshaft 24. Since the cooling fan 25 is configured integrally with the magnet rotor, for example, a magnet (not shown) manufactured of an aluminum alloy and configured to generate power to an ignition coil 26 is disposed at a portion of an outer circumferential side. In addition, the cooling fan 25 functions as an attachment base of a starting pawl configured to drive the crankshaft 24 from a recoil starter 29.

A fuel tank 18 is installed at a side (a front side) of a crank case 23 opposite to the piston. A fuel is supplied from the fuel tank 18, a fuel-air mixture of the air and the fuel is generated by a carburetor (not shown), and the fuel-air mixture is supplied into the cylinder 21 (the combustion chamber) from an intake port (not shown). The supplied fuel-air mixture is ignited by the ignition plug 27 at a predetermined period. When the piston 22 is moved toward a bottom dead center after combustion and the exhaust hole 21*b* is opened, an exhaust gas EX1 is discharged from the exhaust hole 21*b* to flow into the muffler 40 as shown by a dotted line. Meanwhile, since the cooling fan 25 is rapidly rotated by rotation of the crankshaft 24, the cooling fan 25 suctions external air via the ventilator windows 9*a* and 9*b* (see FIG. 1) of the fan cover 9 as shown by arrows IN and blows the cooling air CA along an inner wall of an air guide cover 28. The cooling air CA is guided in a direction of the cylinder 21 via an air duct by the air guide cover 28 formed in a volute shape, and flows in a direction of the muffler 40 through and between the radiation fins 21*a* extending around a cylindrical portion of the cylinder 21. Here, since the plurality of radiation fins 21*a* are stacked in an axial direction while extending from the cylindrical section of the cylinder 21 in the radial direction, the cooling air CA flows into a space sandwiched between the radiation fins 21*a* in the forward/rearward direction like a tip portion of an arrow of the cooling air CA. As shown by the arrows of FIG. 2, while a state in which the cooling air CA flows between a radiation fin (a first fin) closest to an ignition plug and the next radiation fin (a second fin) among the radiation fins 21*a* is shown, the cooling air CA also flows between third to sixth fins of the cylinder and also flows to the fins of a cylinder head portion behind the first fin. The cooling air flowing between the first to fourth fins is divided upward and downward by the cylindrical portion of the cylinder 21 and collides with a wall surface of a cylinder side of the muffler 40 (here, the muffler gasket 49 is interposed therebetween). Since muffler gasket 49 is disposed between the muffler 40 and the cylinder 21 and also functions as a heat shield plate and an air guide plate, the cooling air flows into the muffler chamber at upper and lower portions of the muffler 40.

In the engine main body section 20, the carburetor (not shown) and the muffler 40 are disposed to be spaced about 90° therefrom around an axis of the engine. When seen in the axial direction of the cylinder, the cooling fan 25 is disposed at one side (a left side), the muffler 40 is disposed at an opposite side (a right side), and the cooling fan 25, the cylinder 21 and the muffler 40 are linearly disposed in the axial direction of the crankshaft. As a result of the disposition, since the muffler 40 is disposed under the cooling air CA after cooling the cylinder 21, cooling of the muffler 40 can be efficiently performed.

Figure 3:
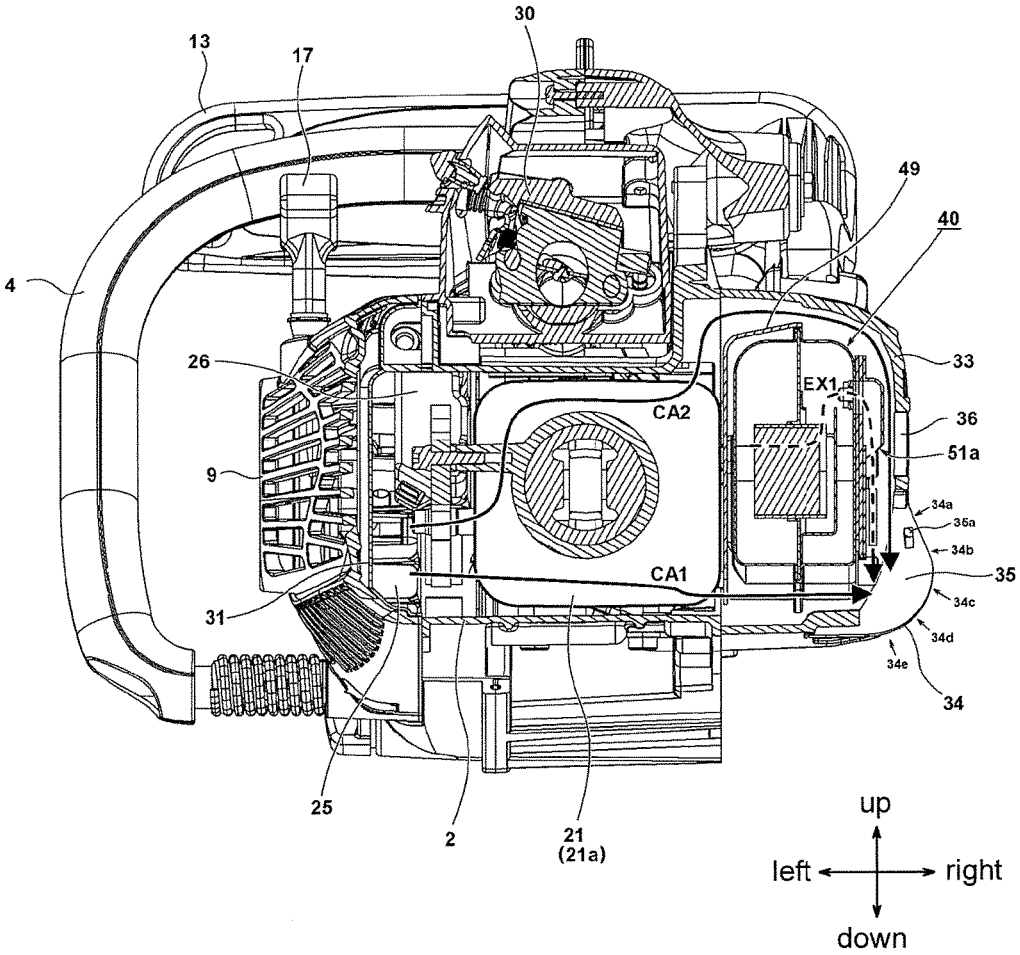
FIG. 3 is a cross-sectional view taken along line B-B of FIG. 1.

FIG. 3 is a cross-sectional view taken along line B-B of FIG. 1. The exhaust gas EX1 of the muffler 40 flows like a dotted line and is discharged downward along a first wall surface (a wall surface opposite to the engine) of the muffler 40 from an exhaust gas outlet 51*a*. Here, the exhaust gas EX1 discharged from the exhaust gas outlet 51*a* is discharged from the vicinity of an opening 35 (to be described below in detail) sandwiched between ribs 34 toward mainly a downward direction to the outside. A carburetor 30 is disposed over the cylinder 21, and the muffler 40 and the carburetor 30 are disposed to be spaced at an interval of about 90 degrees from the axial direction of the cylinder 21.

The cooling air CA shown in FIG. 2 are separated into upper and lower sides while flowing along the radiation fins 21*a*, and cooling air CA1 of the lower side flows toward the vicinity of the opening 35 of the muffler cover 33 along a second wall surface under the muffler 40. Accordingly, the cooling air CA1 collides with and meets the exhaust gas EX1 to be perpendicular thereto and merges with the exhaust gas EX1. Since the cooling air CA1 linearly flows from a lower portion of the cooling fan 25 toward the cylinder 21 to reach the opening 35 from a bottom surface of the muffler 40, an air duct of the cooling air CA1 can be smoothly formed with no curve, and since there is no air duct resistance, a sufficient amount of air can be secured.

After the cooling air CA2 of the upper side reaches a space between the stacked radiation fins 21*a* from the cooling fan 25, the cooling air CA2 is guided into an upper space of the muffler chamber by the muffler gasket 49 through an upper side of a cylindrical portion of the cylinder 21 and flows in a rightward direction through a wall surface (a third wall surface) of an upper side of the muffler 40, after that, a flow direction along an inner wall surface of the muffler cover 33 is curved in a downward direction from the rightward direction, and the cooling air CA2 flows toward the vicinity of the opening 35 through a space between the exhaust gas EX1 and the muffler cover 33. Here, the cooling air CA2 is slowly mixed with exhaust gas EX1 while flowing along a wall surface (a first wall surface) outside the muffler 40 in the same direction as the exhaust gas EX1. A temperature of the exhaust gas EX1 is decreased by the mixing. Since an air flow layer is formed between the exhaust gas and the muffler cover by the second cooling air because the second cooling air merges with the exhaust gas substantially in parallel from an upstream side in an exhaust gas outflow direction between the muffler cover 33 and the muffler 40, even when a distance between the muffler and the muffler cover is reduced and the muffler cover is decreased in size, an exhaust gas temperature can be reduced by mixing the second cooling air and the exhaust gas together without the exhaust gas coming in contact with the muffler cover. In the embodiment, further, the exhaust gas temperature discharged to the outside from the opening 35 of the muffler cover 33 can be sufficiently reduced by colliding the cooling air CA1 flowing under the muffler 40 with the exhaust gas EX1 and the cooling air CA2 in a direction substantially perpendicular thereto and further mixing the cooling air CA1 with the exhaust gas EX1. A flow velocity of the exhaust gas EX1 is sufficiently larger than that of the cooling airs CA1 and CA2. Accordingly, even when the exhaust gas EX1 and the cooling air CA2 are mixed and the exhaust gas EX1 and the cooling air CA1 are mixed, the exhaust gas EX1 is diffused in a flow direction, and most of the exhaust gas EX1 flows in a downward direction with no change in direction and is discharged outside from the opening 35 of the muffler cover 33.

Figure 4:
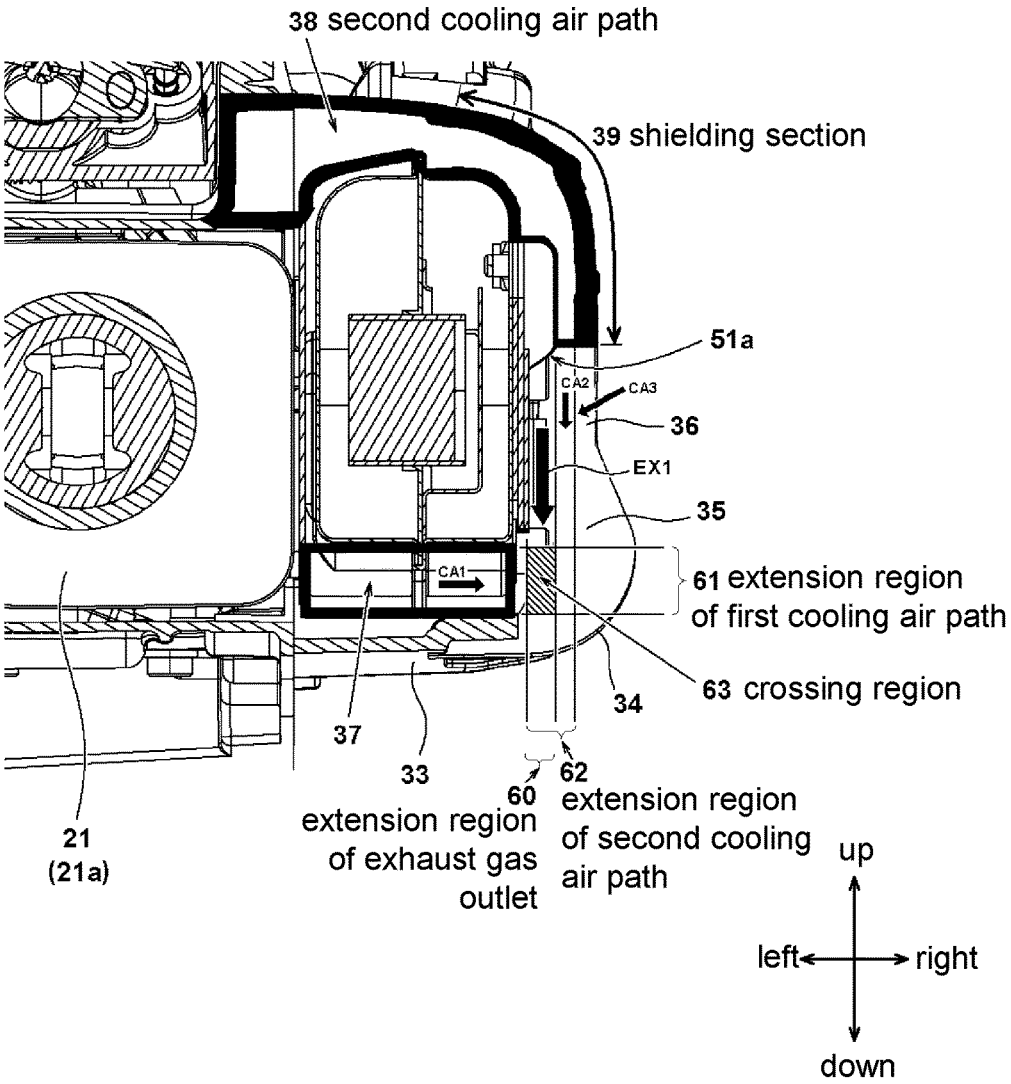
FIG. 4 is a view for describing a shape of a muffler chamber of the chain saw 1 according to the embodiment of the present invention.

FIG. 4 is a view for describing a relation between the exhaust gas EX1 and the cooling airs CA1 and CA2 in the flow direction. In the embodiment, a first cooling air path 37 configured to guide the first cooling air CA1 to cross (collide with) the exhaust gas EX1 and surrounded by a thick-bordered box is provided, and a second cooling air path 38 configured to guide the second cooling air CA2 to join the exhaust gas EX1 substantially in parallel from an exhaust gas restriction member 50 from an upstream side in the exhaust gas outflow direction and surrounded by a thick-bordered box is provided. An extension region 60 of the exhaust gas outlet 51*a* through which the exhaust gas EX1 is discharged crosses an extension region 61 (in a flow direction of a downstream side) of the first cooling air path 37 in a crossing region 63 shown by diagonal lines. Here, while the crossing region is shown in a two-dimensional shape by a cross-sectional view, the crossing region is a crossing space in actuality. In the embodiment, the crossing space including the crossing region 63 is disposed inside (a side closer to the cylinder 21) of an outer exterior edge position (a portion shown by arrows 34*a* to 34*e* in FIG. 3) of the muffler cover 33. According to such a positional relation, since the temperature of the exhaust gas EX1 is reduced by the cooling air CA1 in a space inside of the opening 35, the temperature of the exhaust gas EX1 discharged into the external air from the opening 35 is greatly reduced. In the embodiment, as the cooling air CA2 further flows along the exhaust gas EX1 and is mixed with the exhaust gas EX1 in an extension region 62 of a cooling air path of the cooling air CA2, the temperature of the exhaust gas EX1 can be further reduced. Here, the external air is introduced into the muffler cover 33 via an opening 36 as cooling air CA3 by an action of a flow of the cooling air CA2 directed in a downward direction at a downstream side of the exhaust gas outlet 51*a*, and merges with the cooling air CA2 and the exhaust gas EX1. Further, in the embodiment, while the cooling air CA1 and the exhaust gas EX1 collide with each other at an angle of about 90 degrees when seen in a side view, the collision angle is not limited to only 90 degrees, and the collision angle may be about 30 to 150 degrees as long as the exhaust gas EX1 and the cooling airs CA1 and CA2 are effectively mixed with each other due to collision.

Figure 5:
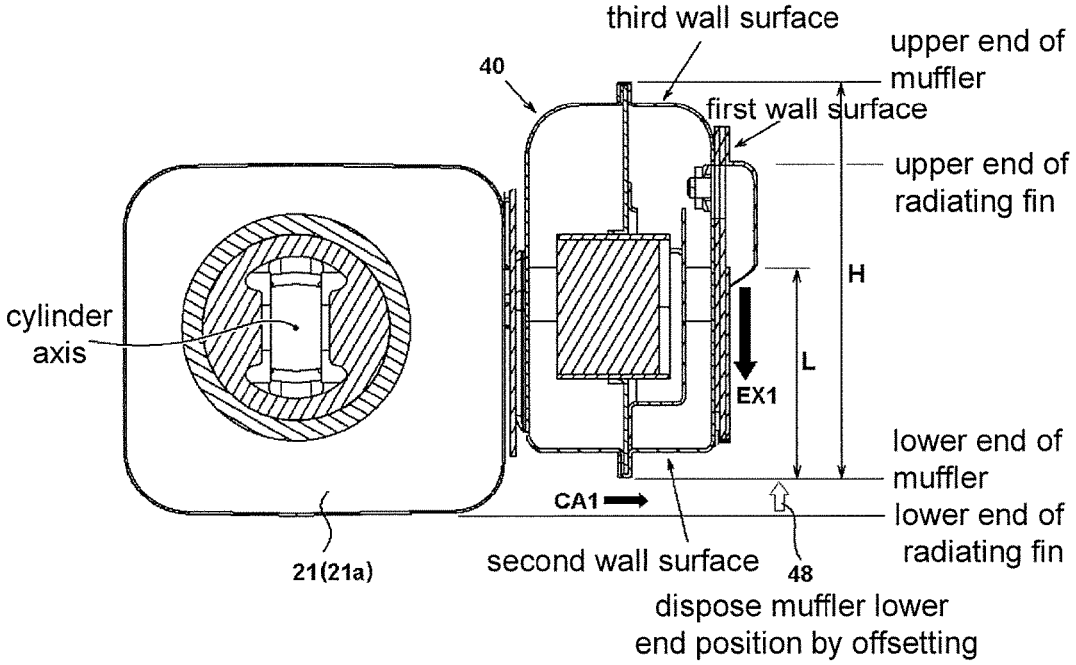
FIG. 5 is a schematic view for describing an offset disposition of a muffler 40 with respect to a cylinder 21 of the chain saw 1 according to the embodiment of the present invention.

FIG. 5 is a view for describing an offset disposition of the muffler 40 with respect to the cylinder 21 of the chain saw 1 according to the embodiment of the present invention. In the embodiment, in order to form the first cooling air path 37 for the cooling air CA1, the muffler 40 is disposed with respect to the radiation fins 21*a* of the cylinder 21 while being offset upward like an arrow 48. That is, the muffler 40 is biasedly disposed such that a central position in the muffler 40 in the upward/downward direction is offset in a tangential direction with respect to a central position in an outer side of the radiation fins 21*a* when seen in the axial direction of the cylinder 21. In addition, a distance L from a lower end of the muffler 40 to the exhaust gas outlet 51*a* is a half or more of a height H of the entire muffler 40, and thus, a distance from the exhaust gas outlet 51*a* to the opening 35 (see FIG. 4) is sufficiently secured. Further, as a result that a lower end position of the muffler 40 is offset upward further than a lower end of the radiation fin 21*a* of the cylinder 21, since a distance from the exhaust gas outlet 51*a* to the outlet of the opening 35 can be further increased, it is preferable to decrease the temperature of the exhaust gas EX1. Meanwhile, an upper end position of the muffler 40 is sufficiently upward further than the position of the radiation fin 21*a* of the cylinder 21. Accordingly, a centerline of the muffler 40 is biasedly disposed to be offset upward with respect to a centerline of an outer side of the radiation fin 21*a* of the cylinder 21. In this way, in the embodiment, when seen in the axial direction of the cylinder 21, since the muffler 40 is biasedly disposed with respect to the cylinder 21 and the first cooling air CA1 exhausted after cooling the cylinder 21 flows into the space that is opened by the offset, it is possible for the first cooling air CA1 to collide with the exhaust gas EX1 at a large crossing angle.

Figure 6:
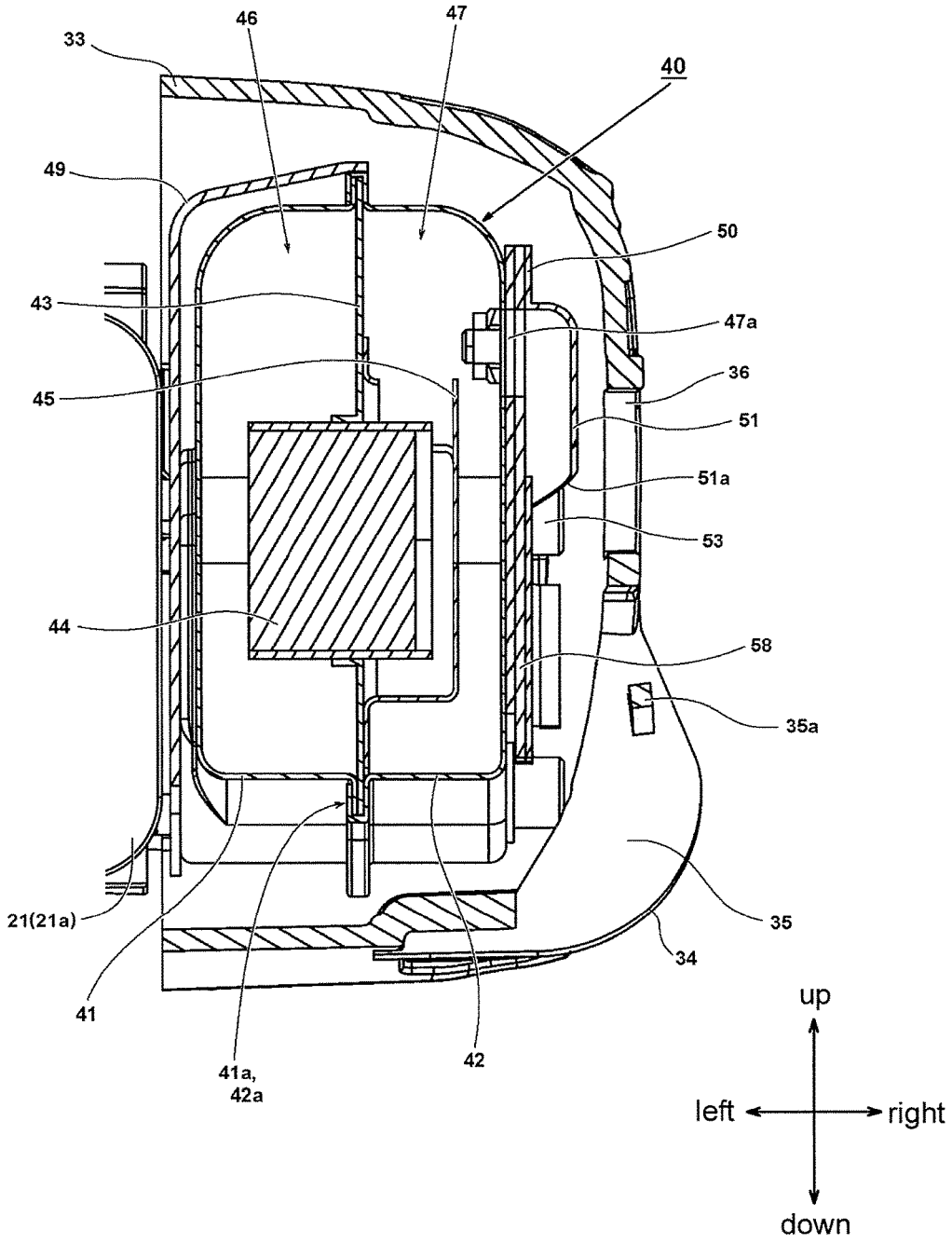
FIG. 6 is a cross-sectional view for describing a configuration of the muffler 40 of the chain saw 1 according to the embodiment of the present invention.

Next, a structure of the muffler 40 fixed to the cylinder 21 by screws will be described with reference to FIG. 6. FIG.

6 is a partially enlarged cross-sectional view of the muffler 40 of FIG. 3. The muffler 40 is matched and joined to opening sections of an inner housing 41 close to the cylinder 21 and an outer housing 42 far from the cylinder 21, and formed in a substantially rectangular parallelepiped shape such that an outer edge portion 42*a* of the outer housing 42 is turned back and caulked to ribs 41*a* that are formed outside. Here, as the inner housing 41 and the outer housing 42 are joined to each other with intervention of the partition plate 43, a first expansion chamber 46 in communication with the exhaust hole 21*b* of the cylinder 21 and a second expansion chamber 47 serving as an exhaust gas outlet side and configured to discharge the exhaust gas to the atmosphere are defined. Here, an opening (an intake port) of the first expansion chamber 46 has a shape that is directly fixed to the cylinder 21, and fixed by the two bolts 53. While a catalyst 44 configured to purify an exhaust gas is installed from the first expansion chamber 46 to the second expansion chamber 47 and the exhaust gas EX1 (see FIG. 3) passes through the catalyst 44 installed in the opening section of a partition plate 43 to flow from the first expansion chamber 46 toward the second expansion chamber 47, here, a catalyst cover 45 configured to suppress an increase in temperature of the outer housing 42 is provided such that a high temperature exhaust gas discharged from the catalyst 44 does not directly hit the outer housing 42. The partition plate 43 and the catalyst cover 45 can be manufactured by pressing, for example, a stainless plate. The exhaust gas expanded in the second expansion chamber 47 flows from an opening 47*a* of the second expansion chamber 47 toward an exhaust gas passage 51 and is discharged into a space (a muffler chamber) covered by the muffler cover 33 from the exhaust gas outlet 51*a* of the exhaust gas passage 51.

The exhaust gas passage 51 is a passage configured to determine a discharge direction of the exhaust gas formed by the exhaust gas restriction member 50 attached to an outer wall surface of the outer housing 42, a tubular pipeline by the exhaust gas passage 51 extends downward, and the exhaust gas outlet 51*a* serving as the opening is formed downward. The exhaust gas restriction member 50 is another member fixed to the outer housing 42 by screws, and installed to hold a spark arrester 58 having a metal net shape and disposed in the vicinity of the opening 47*a* of the outer housing 42. The exhaust gas passage 51 is formed by pressing a metal plate member, and the exhaust gas EX1 flows downward along a wall surface (in a direction perpendicular to the axial direction of the cylinder 21) of the outer housing 42 (the exhaust gas restriction member 50) according to the shape of the exhaust gas passage 51. The exhaust gas discharged into the muffler chamber is discharged into the atmosphere from the opening 35 with front and rear sides thereof sandwiched between the ribs 34.

The ribs 34 are formed to extend in a direction substantially parallel to the discharge direction of the exhaust gas EX1.

A space is formed between the muffler cover 33 and the muffler 40 at predetermined intervals such that radiant heat of the muffler 40 cannot be easily transferred to the muffler cover 33 formed of a synthetic resin, and the muffler gasket 49 is installed between the muffler 40 and the cylinder 21. The muffler gasket 49 is, for example, a graphite sheet, and interposed to obtain good adhesion property between the muffler 40 and the exhaust hole 21*b* of the cylinder 21. In the embodiment, the muffler gasket 49 is also used as a baffle plate configured to guide the cooling air in a predetermined direction while serving as a heat shield plate to suppress transfer of heat of the muffler 40 toward the cylinder 21 in addition to a function as a gasket. The opening 36 serving as a ventilator window is installed in the vicinity of the exhaust gas outlet 51*a* of the muffler cover 33. The opening 36 is formed adjacent to the large opening 35 serving as an outlet of the exhaust gas, and formed to suction a low temperature external air using a flow of the cooling air CA2 while improving heat dissipation during stoppage.

Figure 7:
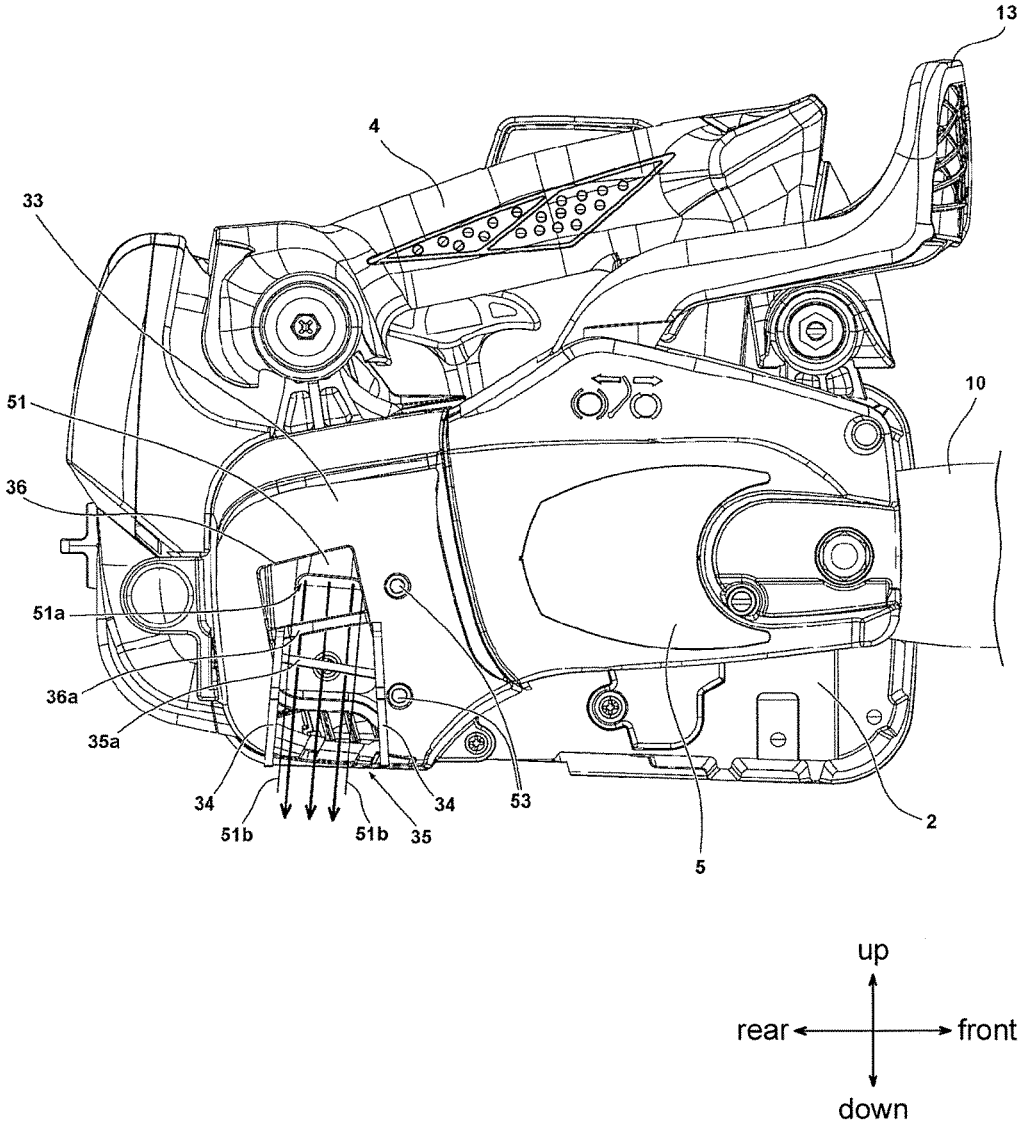
FIG. 7 is a right side view of the chain saw 1 according to the embodiment of the present invention.

FIG. 7 is a right side view of the chain saw 1. The opening 35 serving as an outlet of the exhaust gas EX1 to the atmosphere is formed in a side surface of the muffler cover 33, and the exhaust gas EX1 flowed out of the exhaust gas outlet 51*a* is discharged in a downward direction like an arrow. The opening 35 is formed between the two ribs 34, and the opening 36 having a substantially rectangular shape is formed over an imaginary line that connects the vicinities of upper ends of the two ribs 34. A beam 36*a* extending in a lateral direction and configured to increase strength of the muffler cover 33 is formed between the opening 35 and the opening 36. Further, while a beam 35*a* extending diagonally is provided even in the opening 35, which position the beam 35*a* is formed can be arbitrarily set as long as the flow of the exhaust gas EX1 is not disturbed. In the embodiment, while the exhaust gas EX1 is discharged from the opening 35 of the muffler cover 33 in a substantially downward direction, the cooling airs CA2 and CA3 (see FIGS. 3 and 4) flowing to cover the exhaust gas EX1 in a direction from upward to downward cross each other at this time, and then, cross the cooling air CA1 (see FIG. 3) that flows under the muffler 40 from a left side to a right side in a horizontal direction. However, since a flow velocity of the exhaust gas EX1 is large, a flow direction of the exhaust gas EX1 is basically not varied in the downward direction even when the cooling airs CA1, CA2 and CA3 are mixed. In this way, in the embodiment, since the cooling airs CA1, CA2 and CA3 having a temperature sufficiently lower than that of the exhaust gas EX1 can be mixed while diffusing the exhaust gas EX1, the temperature when the exhaust gas EX1 is discharged outside of the muffler cover 33 can be greatly reduced.

Figure 8:
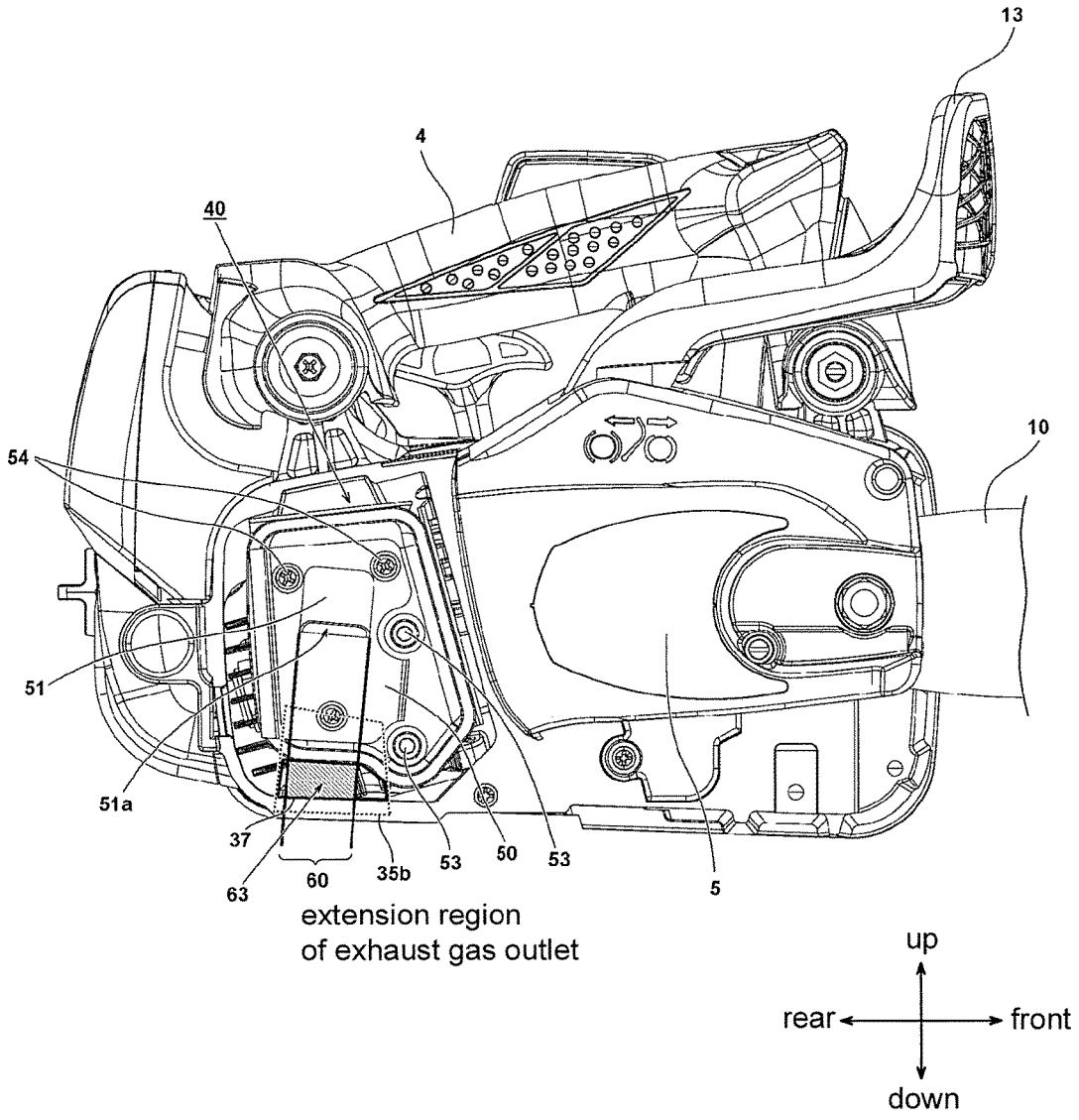
FIG. 8 is a right side view of the chain saw 1 in a state in which a muffler cover 33 according to the embodiment of the present invention is removed.

FIG. 8 is a right side view of the chain saw 1 in a state in which the muffler cover 33 is removed. The exhaust gas passage 51 of the muffler 40 is formed in the exhaust gas restriction member 50 fixed to the muffler 40 by three screws 54. While most of a wall surface (a first wall surface) of the muffler 40 opposite to the engine is covered by the exhaust gas restriction member 50, not only the size of the exhaust gas restriction member 50 but also presence or absence of the specification thereof is optional. A thick solid line 51*b* around the exhaust gas EX1 in the discharge direction is an extension line of the wall surface of the exhaust gas passage 51, and the exhaust gas EX1 is discharged while being slowly diffused in the extension region mainly between the thick lines. The discharge direction of the exhaust gas EX1 is slightly diagonally discharged toward a slightly rearward side while directed in a downward direction. Then, since the exhaust gas EX1 and the cooling air CA1 cross each other in a region inside of a contour line 35*b* shown by a dotted line of the opening 35 of the muffler cover 33, the temperature of the exhaust gas EX1 can be greatly reduced when the exhaust gas EX1 is discharged outside of the muffler cover 33. Further, since the opening 36 (see FIG. 7) is newly formed over the opening 35 of the muffler cover 33, a normal temperature air that is not heated by the engine main body section 20 or the muffler 40 can be supplied into the muffler cover 33 from the outside via the opening 36.

Figure 9:
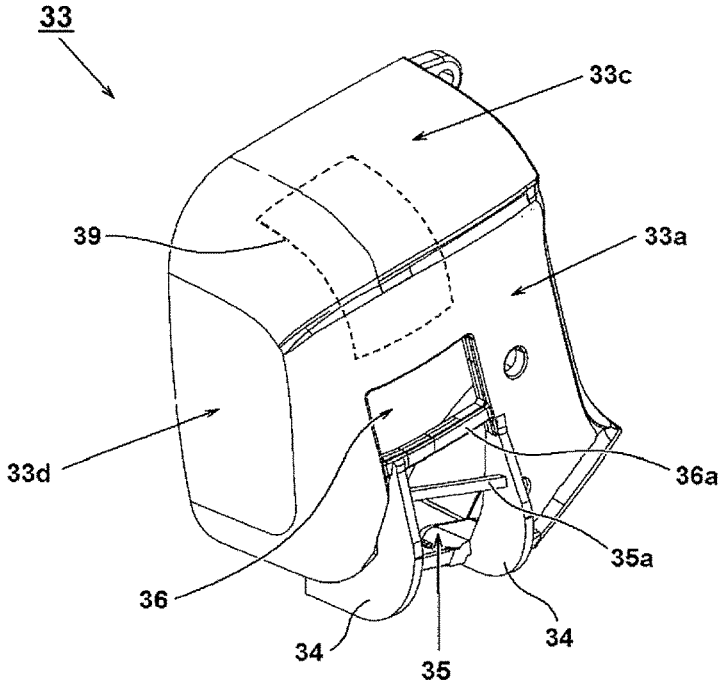
FIG. 9 is a perspective view of the muffler cover 33 of FIG. 1 as a single body.

FIG. 9 is a perspective view showing an appearance of the muffler cover 33. In the embodiment, the muffler cover 33 is formed in a shape having a right side surface 33*a*, a front side surface, an upper surface 33*c*, a rear side surface 33*d* and a rear surface, and only two openings 35 and 36 are formed. According to such a configuration, the cooling airs CA1 and CA2 flowing into the muffler chamber are discharged to the outside from the opening 35 together with the exhaust gas EX1. In particular, since a flow of the cooling air CA2 is converted into a flow in a downward direction from a horizontal direction from left to right by an inner wall portion (a shielding section 39) of the upper surface 33*c* of the muffler cover 33 shown by a dotted line, the cooling air CA2 can flow substantially parallel to the exhaust gas EX1 from an upstream side to a lower side in the exhaust gas outflow direction with respect to the exhaust gas EX1 to join the exhaust gas EX1. As a result, a layer of a low temperature air flow can be formed between the exhaust gas EX1 and the muffler cover 33. Further, since the air flow layer is formed between a lower side of the muffler 40 and the muffler cover 33 by the first cooling air, the muffler cover 33 can be effectively protected from a high temperature of the muffler 40. In the embodiment, since transfer of heat to the muffler cover 33 is reduced in addition to improvement of a cooling effect for the muffler 40, the muffler cover 33 can be reduced in size by reducing a distance between the muffler 40 and the muffler cover 33.

Next, a variant of the embodiment will be described with reference to FIG. 10. The muffler cover 33 shown in FIG. 9 has an effect of largely reducing a temperature of the exhaust gas during an operation of the engine, and the muffler cover 33 is heated by radiant heat of the heated muffler 40 because the flows of the cooling airs CAI and CA2 are stopped during stoppage of the engine. Here, like the muffler cover widely used in the current engine-driven working machine, a muffler cover 83 having a plurality of ventilator windows is provided. A ventilator window 91 is formed at an upper surface of the muffler cover 83, a ventilator window 94 is formed at a right side surface, and ventilator windows 95 and 96 are formed at a rear side surface. However, a cavity 92 of the upper surface is a cavity having the same shape as the ventilator window 91 adjacent thereto in the forward/rearward direction, and the cavity 92 is not in communication with the inside of the ventilator window 91 to prevent the air from passing therethrough. Similarly, a cavity 93 of the right side surface is a cavity having the same shape as the ventilator window 94 adjacent thereto in the forward/rearward direction, and the cavity 93 is not in communication with the inside of the ventilator window 94. Shapes of ribs 84 and openings 85 and 86 are substantially the same as the rib 34 and the openings 35 and 36 of the first embodiment. According to the above-mentioned configuration, the muffler cover having good heat dissipation can be realized while maintaining a function of the shielding section 39 shown in FIG. 9. Further, an airflow break plate or an air guide plate constituted by another member may be installed inside a portion corresponding to 93 and 94 (referring to FIG. 9, a portion of the shielding section 39) as an opening passing through the cavities 92 and 93 like the ventilator windows 91 and 94. Fox example, a slightly thick aluminum foil may be adhered to the muffler cover 83 in a portion of the shielding section 39.

Figure 10:
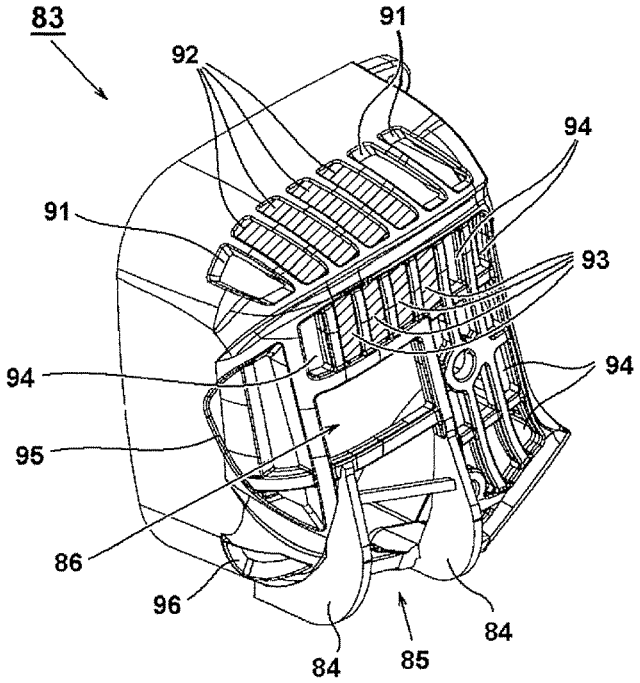
FIG. 10 is a perspective view of a muffler cover 83 according to a second embodiment of the present invention.

Even when the plurality of ventilator windows are formed as shown in FIG. 10, since the cooling air CA2 divided in an upward direction of the muffler 40 through and between the radiation fins 21*a* of the cylinder 21 flows in the same direction as the exhaust gas EX1 by a shielding section formed by a wall portion (adjacent to an arrow 97) of the upper surface and the cavities 92 and 93 as described in FIGS. 3 to 7, a temperature decrease effect for the exhaust gas EX1 during an operation of the engine is not damaged. Even in the variant, since a distance between the exhaust gas outlet of the exhaust gas restriction member and the crossing region can be increased, a distance over which the second cooling air and the exhaust gas can be mixed together can be increased, and the exhaust gas temperature can be substantially reduced. In addition, the exhaust gas after mixing with the first cooling air can be discharged to the outside of the muffler cover with no contact with the exhaust outlet section of the muffler cover. Further, since there is no need to extract some of the cooling air from the cooling fan and form an air duct separately from the cylinder, a compact structure can be provided at low cost. Here, an amount of the air for cooling the cylinder is reduced by extracting some of the cooling air and the cylinder temperature is not increased.

Hereinabove, while the present invention has been described based on the embodiments, the present invention is not limited to the above-mentioned embodiments and various modifications may be made without departing from the spirit of the present invention. For example, in the above-mentioned embodiments, while the structure of the engine has been described using the chain saw as an example of the engine-driven working machine has been described, the engine-driven working machine may also be applied to another engine-driven working machine such as a bush cutter, a hedge trimmer, a cutter, or the like, or an engine serving as a generator or a small power source, in addition to the engine for the chain saw. In addition, the engine main body section may also be similarly applied to not only a 2-cycle engine but also a 4-cycle engine, and a type of the used muffler may also use various types matched to working devices.

The invention claimed is:

1. An engine comprising: a cylinder having a plurality of fins on an outer circumferential section thereof and in which a combustion chamber is formed; a cooling fan configured to generate cooling air to cool the cylinder; and a substantially rectangular parallelepiped muffler attached to the cylinder, wherein an exhaust gas outlet is installed in the muffler to discharge an exhaust gas along a first wall surface of the muffler in a direction perpendicular to an axial direction of the cylinder, a second wall surface is disposed at a downstream side in a discharge direction of the exhaust gas when seen from the first wall surface and extends in a direction crossing the first wall surface, a muffler cover configured to cover the muffler is provided, and first cooling air passing through and between the fins flows along the second wall surface and merges with the exhaust gas at the inside of an outer exterior edge position of the muffler cover.

2. The engine according to claim 1, wherein an exhaust gas passage including the exhaust gas outlet and configured to determine a discharge direction of the exhaust gas is formed in the muffler, and the exhaust gas passage is disposed to be biased at an upstream side in an exhaust gas outflow direction on the first wall surface of the muffler.

3. The engine according to claim 1, wherein the muffler cover covering the muffler forms a muffler chamber, an opening configured to discharge the exhaust gas into external air is formed in the muffler cover, and a crossing region of the first cooling air and the exhaust gas is formed to be disposed inside of the outer exterior edge position of the muffler cover.

4. The engine according to claim 3, wherein ribs configured to guide the exhaust gas are formed in a portion of an edge of the opening of the muffler cover to extend in a direction parallel to a discharge direction of the exhaust gas.

5. The engine according to claim 3, wherein second cooling air flowing through and between the fins flows along the first wall surface after flowing along a third wall surface disposed on an upstream side in the discharge direction of the exhaust gas from the first wall surface and non-adjacent to the second wall surface, and merges with the exhaust gas substantially in parallel from an upstream side in an outflow direction of the exhaust gas.

6. The engine according to claim 5, wherein a crankshaft configured to extract an output of the engine is provided, the cooling fan is installed at one end of the crankshaft, the muffler is disposed on an opposite side of an axis of the cylinder when seen from the cooling fan, and the first cooling air and the second cooling air are exhausted after cooling the cylinder.

7. The engine according to claim 6, wherein a shielding section configured to convert a flow of the second cooling air from along the third wall surface to a flow along the first wall surface is formed on the muffler cover.

8. An engine-driven working machine configured to drive a working machine using the engine according to claim 1.

9. An engine comprising: a cylinder having a plurality of fins on an outer circumferential section thereof and in which a combustion chamber is formed; a cooling fan configured to generate cooling air to cool the cylinder; and a substantially rectangular parallelepiped muffler attached to the cylinder, wherein the muffler is biasedly disposed such that a central position in the muffler is offset in a tangential direction with respect to a central position in an outer side of the fin when seen in an axial direction of the cylinder, first cooling air exhausted after cooling the cylinder flows into a space opened by the biased disposition, and an exhaust gas outlet is configured to discharge an exhaust gas in a direction in which the exhaust gas collides with the first cooling air along a first wall surface of the muffler disposed at an opposite side when seen from the cylinder, wherein a second wall surface extends in a direction crossing the first wall surface, a muffler cover configured to cover the muffler is provided, and the first cooling air flows along the second wall surface and merges with the exhaust gas at the inside of an outer exterior edge position of the muffler cover.

* * * * *